US011420712B2

(12) United States Patent
Chivers et al.

(10) Patent No.: US 11,420,712 B2
(45) Date of Patent: Aug. 23, 2022

(54) SYSTEM AND METHOD FOR THE DEPLOYMENT, TOWING AND RECOVERY OF MARINE EQUIPMENT FROM A WATERBORNE CARRIER

(71) Applicant: Fugro N.V., Leidschendam (NL)

(72) Inventors: Mike Chivers, Leidschendam (NL); Hans Van Der Wiel, Leidschendam (NL); Sebastiaan Cornelis Antonius Van Veldhuizen, Bodegraven (NL)

(73) Assignee: Furgo N.V., Leidschendam (NL)

( * ) Notice: Subject to any disclaimer, the term of this patent is extended or adjusted under 35 U.S.C. 154(b) by 629 days.

(21) Appl. No.: 16/476,943

(22) PCT Filed: Jan. 9, 2018

(86) PCT No.: PCT/NL2018/050011
§ 371 (c)(1),
(2) Date: Jul. 10, 2019

(87) PCT Pub. No.: WO2018/131997
PCT Pub. Date: Jul. 19, 2018

(65) Prior Publication Data

US 2019/0351977 A1 Nov. 21, 2019

(30) Foreign Application Priority Data

Jan. 10, 2017 (NL) ..... 2018151

(51) Int. Cl.
*B63B 21/66* (2006.01)
*B63B 21/16* (2006.01)
(Continued)

(52) U.S. Cl.
CPC ..... *B63B 21/66* (2013.01); *B63B 21/16* (2013.01); *B63B 21/62* (2013.01); *B63B 27/16* (2013.01);
(Continued)

(58) Field of Classification Search
CPC ..... B63B 21/16; B63B 21/62; B63B 27/16; B63B 2027/165; B63B 2211/02;
(Continued)

(56) References Cited

U.S. PATENT DOCUMENTS 2,533,972 A * 12/1950 Symonds ..... A01K 73/04 114/254
3,119,601 A * 1/1964 Blount ..... A01K 73/06 43/8
(Continued)

FOREIGN PATENT DOCUMENTS

FR 2601642 A1 1/1988
WO 2018131997 A1 7/2018

OTHER PUBLICATIONS

International Search Report and Written Opinion; PCT Application No. PCT/NL2018/050011; dated Aug. 2, 2018.
(Continued)

*Primary Examiner* — Gregory W Adams
(74) *Attorney, Agent, or Firm* — Polsinelli PC

(57) ABSTRACT

This document describes a system for the deployment, towing and recovery of marine equipment from a waterborne carrier, which carrier comprises a hoisting arrangement for lifting the marine equipment into the water. The system cooperates with the hoisting arrangement, and comprises a lateral deployment-recovery assembly for deployment and recovery on a lateral side of the carrier, and includes: a tow winch and an aft lateral outrigger connected to the carrier. The assembly also comprises a tow line guide and a guider winch including a guide line attachable to the tow line guide. The aft outrigger comprises a seat for the tow line guide and a sheave for the guide line to enable guiding of the tow line guide to the seat. The document also describes a method.

15 Claims, 5 Drawing Sheets

(51) Int. Cl.
*B63B 27/16* (2006.01)
*B63B 21/62* (2006.01)
*B66C 23/52* (2006.01)

(52) U.S. Cl.
CPC ..... *B66C 23/52* (2013.01); *B63B 2027/165* (2013.01); *B63B 2211/02* (2013.01)

(58) Field of Classification Search
CPC ..... B63B 21/66; B63B 34/67; B63B 21/56; B63B 34/60; B63B 34/54; B63B 23/04; B63B 21/60; B63B 23/32; B63B 23/06; B63B 23/02; B63B 23/48; B63B 23/58; B63B 23/20; B63B 23/34; B66C 23/52
USPC ..... 114/242, 250, 253, 254, 368, 369; 254/280; 405/166; 414/137.6, 137.8, 414/138.4, 193.2
See application file for complete search history.

(56) References Cited

U.S. PATENT DOCUMENTS 4,574,723 A 3/1986 Chiles et al.
4,798,156 A * 1/1989 Langeland ..... G01V 1/3843 367/20
5,378,851 A 1/1995 Brooke et al.
5,408,947 A * 4/1995 Curto ..... B63B 21/66 114/253
5,520,135 A * 5/1996 Rolland ..... B63B 27/36 114/259

OTHER PUBLICATIONS

English abstract of FR26016420; Retreived from www.espacenet.com on Jul. 9, 2019.

* cited by examiner

SYSTEM AND METHOD FOR THE DEPLOYMENT, TOWING AND RECOVERY OF MARINE EQUIPMENT FROM A WATERBORNE CARRIER

CROSS-REFERENCE TO RELATED APPLICATIONS

This application is a national stage application of International Application No. PCT/NL2018/050011, which was filed on Jan. 9, 2018, which claims priority to Netherlands Application Number 2018151 filed on Jan. 10, 2017, of which is incorporated by reference in its entirety.

FIELD OF THE INVENTION

The present invention is directed at a system for the deployment, towing and recovery of marine equipment from a waterborne carrier, the carrier comprising hoisting arrangement including a hoist winch comprising a lift line for lifting the marine equipment from the carrier into a water. The invention is further directed at a method of deploying of marine equipment from a waterborne carrier into the water.

BACKGROUND

Various tasks at sea or on large bodies of water, such as search or monitoring operations of the sea bottom, are performed by towing marine equipment behind a vessel. In the example of sea bottom surveillance or search operations for objects or wreckage, it is typically advantageous that an equipment array or pieces of equipment that are towed behind a vessel, span an as broad as possible tow lane in order to scan a large area while minimizing the distance to be sailed.

To achieve this, some solutions apply paravanes having one or more lines of sensors in between. The paravanes may be shaped or comprise fins that force them outward with respect to the vessels sailing course. Similarly, the paravanes may be designed to sail subsurface when towed. However, the disadvantage of using paravanes is that they usually do not allow much control over their course. The paravanes being towed from the vessels stern using tow lines, assume an outward course (relative to the vessels course) that is dependent on the sailing speed of the vessel and the length of the tow lines. Moreover, paravanes are quite large and require manual handling effort to get them on board. Because the towed objects are also relatively large, the use of paravanes is often not desired from the view point of storage on a vessel and used deck space when being handled. A further disadvantage is that paravanes can only be used under favourable weather conditions that provides only a limited weather window for the paravanes to be used.

Further important, it is not possible to control the depth at which the paravanes are towed through the water. Even if the depth below the vessel could be accurately controlled, then still this would not be sufficient in order to perform a survey on the sea bottom. This is because typically, the height above the sea bottom (and not the depth below the boat) is the parameter that must be controllable to allow a constant surface area to be covered. Otherwise, gaps could appear in the scanned area. Which would require the vessel to sail the same area again to guarantee 100% coverage.

Other solutions that may be thought of is the use of autonomous underwater vehicles (AUV's). However, AUV's are not suitable for large area coverage. The area covered by an AUV is smaller, because it is just one unit and the autonomy is low. Moreover, such vehicles are delicate and costly and are for that reason often not available or desired to perform relatively straightforward sea bottom surveillance or reconnaissance.

A further possibility is to make use of outriggers installed on the vessel's lateral side or sides. An outrigger extends from a lateral side of the hull in order to enlarge the spanning distance of the vessel. Typically the outrigger is extendable and retractable with respect to the hull, being connected thereto for example by a hinging suspension structure. Outriggers enable marine equipment to be towed from a laterally displaced point with respect to the vessel. For performing sea bottom surveillance or reconnaissance, marine equipment may for example be towed using a tow line from the outrigger.

A particular manner of performing sea bottom surveillance, e.g. to identify the location of wreckage or objects such as lost containers or old ammunition, makes use of a towed arrangement of remotely operated towed vehicles (ROTVs). The ROTV's suspend from various positions on the stern of the vessel and on the outrigger or outriggers, each ROTV suspending from a tow line. The tow lines may simultaneously serve as a data cables via which images and other data may be send back to the vessel, and control instructions may be send from the vessel to the ROTV's. Together, the ROTV's may span the desired large spanning distance such as to enable to survey the area by sailing with broad scan lanes. The ROTVs are to sail in close proximity to each other to ensure that the whole area is thoroughly surveyed and no spots or lanes are missed.

Although this manner of surveillance works well in terms of efficiently carrying out the survey, the deployment of ROTVs in particular where these are to be towed from one of the lateral outriggers of the vessel, is not so easy. The tow/data line is vulnerable and prone to damaging if it is curved too much during deployment and/or recovery. Also the ROTV's themselves may damage in case they hit the vessel's hull or hoisting arrangement (or any other part) during deployment and recovery. Moreover, getting the ROTV from the deck into the water, while simultaneously bringing the tow line to the desired position on the outrigger is difficult. To achieve this, various tools such as pick hooks may be used to position the line or untangle it from an undesired blockage, however this is rather cumbersome and dependent on the situation not even efficient. Moreover, it may even be dangerous to the crew performing the deployment and recovery, in case such tools are improperly used.

SUMMARY OF THE INVENTION

It is an object of the present invention to provide a system and method for the deployment, towing and recovery of marine equipment from a waterborne carrier, which overcomes the disadvantages above and allows for safe and efficient deployment under most conditions.

To this end, there is provided herewith a system for the deployment, towing and recovery of marine equipment from a waterborne carrier, the carrier comprising hoisting arrangement including a hoist winch comprising a lift line for lifting the marine equipment from the carrier into a water, wherein the system is configured for cooperating with the hoisting arrangement, and wherein the system comprises at least one lateral deployment-recovery assembly for deployment and recovery of the marine equipment on a lateral side of the carrier, the at least one lateral deployment-recovery assembly including: a tow winch comprising a tow line for towing the marine equipment; and an aft lateral outrigger connected to the carrier for keeping the tow line at an extended position on a lateral side of the carrier during towing; wherein the at least one lateral deployment-recovery assembly further comprises: a tow line guide arranged for receiving the tow line; and a guider winch including a guide line, the guide line being attachable to the tow line guide; wherein the aft lateral outrigger comprises a seat for receiving the tow line guide, and a sheave for guiding the guide line such as to enable guiding of the tow line guide towards the seat.

The guide line and guider winch cooperating with the tow line guide, allow to easily guide the tow line guide to the seat on the outrigger during deployment of the equipment on the lateral side of the carrier (e.g. survey ship or other vessel or tow carrier). Prior to lifting of the equipment, the tow line guide is attached to the tow line and the tow line is connected to the equipment. The tow line guide may be attached by pulling the tow line through a through hole in the tow line guide. Hence, by guiding the tow line guide, the tow line itself can be guided; and by guiding the tow line guide such that it is placed in the seat on the outrigger, the tow line will suspend from the desired position on the outrigger. Guiding of the tow/data line in this manner enables to prevent the tow line from becoming entangled or being forced in curves that may damage the line inside. Moreover, the use of pick hooks or other tools is no longer necessary, and the deployment and recovery may be performed very fast in comparison to conventional deployment.

In accordance with an embodiment of the present invention, the seat is mounted at a first position and the sheave is located at a second position on the aft lateral outrigger, wherein the second position is located at least as remote as the first position from a connection between the aft lateral outrigger and the carrier.

The sheave that guides the guideline, being placed on the aft lateral outrigger directly below the seat, allows to pull the towline guide during deployment directly towards the seat. In case the sheave is placed at a further extended position (with respect to the whole of the carrier) on the outrigger, by pulling the guideline the towline guide will be pulled over the seat. This may provide some additional flexibility during deployment to place the towline guide in the seat. Moreover, as will be explained further with respect to other embodiments, this also allows to effectively place the towline guide in the seat in embodiments wherein the location of the seat can be changed on the outrigger.

In accordance with another embodiment of the present invention, the towline guide is arranged for enabling the towline to be freely movable therethrough, the towline guide comprising a through hole or opening having a size that is larger than a diameter of towline. This allows the towline to be extended through the through hole or opening such as to attach the towline guide thereto, as explained above.

In accordance with some particular embodiments, the towline guide is shaped such as to enable to be circumferentially arranged around the towline, the towline guide for example comprising at least one of a group comprising: an annulus or annular part, a cylinder, a hyperboloid, or a double conical cylinder. Towline guides having a shape which is more or less as described hereinabove, enable straightforward and secure placing thereof in a correspondingly shaped seat on the outrigger. For example, a hyperboloid shaped towline guide or a towline guide which is shaped as a double conical cylinder, comprises a thin part having a smaller diameter then the end parts of the cylinder, and thus provide natural mechanical stability when placed in a seat that is smaller than the length of the towline guide itself, and which is properly dimensioned to support the thin part. The seat may for example be correspondingly shaped. Optionally, a controllable force may be applied, such as an electromagnetic force that can be switched on and off, to keep the towline guide in the seat during towing.

Accordingly, in accordance with some particular embodiments, the seat is shaped such as to allow receipt of the tow line guide, the seat for example comprising a V-shaped or U-shaped part for receiving the tow line guide. As will be appreciated, a V-shaped or U-shaped seat straightforwardly allows to receive the towline guide having a shape such as described hereinabove.

In accordance with yet a further embodiment, the seat is movably mounted on the aft lateral outrigger, such as to enable adjustment of a tow point from where the tow line is towed via the aft lateral outrigger. For example, the seat may be installed on a rail such that the position of the seat on the outrigger can be changed by moving of the seat through the rail.

In accordance with some particular embodiments, the sheave and the seat are located on a same side of the aft lateral outrigger (e.g. an upper side). In particular in combination with a sheave being located at a further extended position on the aft lateral outrigger, as described hereinabove, a proper shape of the seat (e.g. an asymmetrical tilted V-shape or U-shape) pulls the towline guide over the rail wherein the seat is installed. When the towline guide encounters the seat, it will be automatically received therein.

In accordance with yet a further embodiment, the at least one lateral deployment-recovery assembly further comprises a front lateral outrigger connected to the carrier between the tow winch and the aft lateral outrigger, including a guide for receiving the tow line. Using an additional outrigger allows positioning of the tow winches more forward on deck of the carrier or vessel, thereby creating the required deck space to handle the towed objects on deck. The front lateral outriggers guide the towing/data cable with the least possible amount of bends and largest possible radius of bends if any. Using front lateral outriggers, however, does not dispense with the preferred application of aft lateral outriggers, which are still preferred in combination with the front lateral outriggers. Even with the front lateral outriggers, aft lateral outriggers are desired on the stern to prevent the towed cable to cross the propellers when the vessel is making a turn.

It is noted that, instead of or in addition to the use of front lateral outriggers, the aft lateral outriggers may also be shaped differently to allow these to be placed more to the front of the vessel to achieve the same effect as above. For example, curved or bended aft lateral outriggers may be provided which are curved or bended with their outward ends in the backward direction with respect to the sailing of the vessel or carrier. This allows to place the aft lateral outriggers more to the front on the vessel, without necessarily using additional means to prevent the cable from crossing the propellers. Also, the aft lateral outriggers may be placed under an angle such as to lean backward, to obtain the same effect.

In accordance with yet a further embodiment the at least one lateral deployment-recovery assembly includes: a first lateral deployment-recovery assembly for deployment and recovery of a first marine equipment unit on a first lateral side of the carrier; and a second lateral deployment-recovery assembly for deployment and recovery of a second marine equipment unit on a second lateral side of the carrier. As may be appreciated, this embodiment allows to deploy, tow, recover marine equipment on opposite lateral sides of the tow carrier, thereby enlarging the survey lane formed by the towed marine equipment.

In yet a further embodiment, the system further comprises a mid tow winch unit for enabling towing of a further marine equipment unit, the further marine equipment unit to be lifted into the water by the hoist arrangement directly. The further marine equipment unit will thereby be towed suspending from the stern of the carrier, for example amidships. Because an amidships tow is more easily deployed and recovered from the water, no additional guides or winches are necessary (although these may of course be used) to perform deployment and recovery.

In a further embodiment of the present invention, the system further comprises a controller for controlling one or more winches of the at least one lateral deployment-recovery assembly or the hoist winch. The controller may for example control any one or more of the tow winches or guide winches as well as the hoist winch of the carrier, to perform a coordinated operation thereof in order to lift the marine equipment unit and guide the tow line guide using the guider winch simultaneously. Therefore, in accordance with embodiments, the controller is arranged for coordinating operation of one or more of the hoist winch, the guider winch or the tow winch, such as to perform one or more steps of the method in accordance with the third aspect described further below.

In accordance with a second aspect, there is provided a carrier, such as a vessel, for the deployment, towing and recovery of marine equipment into water, the carrier comprising a system as described in accordance with the first aspect of the invention.

Yet in accordance with a third aspect of the present invention there is provided a method of deploying marine equipment from a waterborne carrier into a water, wherein the marine equipment is to be deployed into the water at a lateral side of the carrier, the method including: connecting a tow line provided by a tow winch to the marine equipment, the tow line extending from a tow winch; connecting a lift line to the marine equipment, the lift line being provided by a hoist winch of a hoisting arrangement on the carrier; and lifting the marine equipment from the carrier into the water using the hoisting arrangement; wherein the deployment is performed using a lateral deployment-recovery assembly, the method thereby further comprising the steps of: prior to connecting the tow line, extending the tow line through a tow line guide, and connecting the tow line guide to a guide line provided by a guider winch, the guide line running over a sheave on the aft lateral outrigger; and during said lifting of the marine equipment, operating the guider winch such as to pull the tow line guide towards a seat mounted onto the aft lateral outrigger connected to the carrier, for keeping the tow line at an extended position on a lateral side of the carrier during towing.

In accordance with some embodiment of the method in accordance with the third aspect, the marine equipment comprises at least one of: a remotely operated towed vehicle; an array of remotely operated towed vehicles, such as a plurality of remotely operated towed vehicles towed side-by-side; one or more autonomous underwater vehicles; a seismic sensor array; one or more paravanes; or a combination of marine equipment units.

BRIEF DESCRIPTION OF THE DRAWINGS

The invention will further be elucidated by description of some specific embodiments thereof, making reference to the attached drawings. The detailed description provides examples of possible implementations of the invention, but is not to be regarded as describing the only embodiments falling under the scope. The scope of the invention is defined in the claims, and the description is to be regarded as illustrative without being restrictive on the invention. In the drawings:

DETAILED DESCRIPTION

Figure 1:
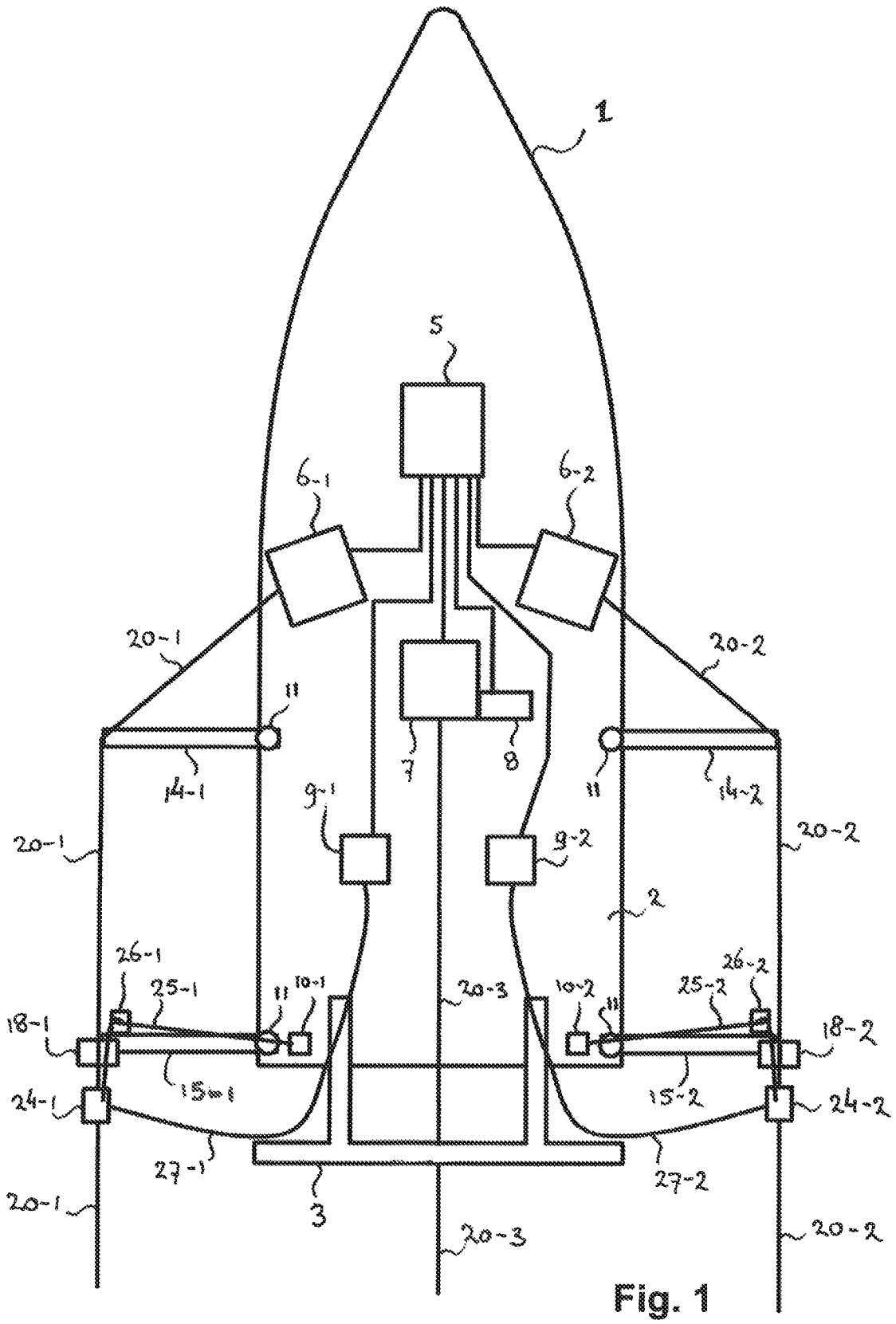
FIG. 1 schematically illustrates a carrier including a system in accordance with the present invention.

FIG. 1 schematically illustrates a deployment vessel or carrier 1, on which a system for the deployment towing and recovering of marine equipment is implemented. The carrier 1 comprises a deck 2 on which most of the system parts are arranged. The deck includes an A-frame 3 for hoisting equipment and other parts from the deck 2, for example for deployment into the water. Instead of an A-frame, a different hoisting arrangement may be available on deck 2, such as a crane or different kind of construction.

On deck 2, a control system 5 is operatively connected with a plurality of system parts for operation thereof. As illustrated in FIG. 1, the control system 5 is connected to winches 6-1, 6-2, 7, 8, 9-1 and 9-2. The connection illustrated in FIG. 1 is a wireline connection, however the skilled person may appreciate that at any type of functional connection between the control system 5 and any of the system parts, such as wireless connections or wireline connections, of any type, may be used for providing the connection between the control system 5 and the system parts. Moreover, FIG. 1 does not illustrate a wireline connection between the control system 5 and any of the outriggers 14-1, 14-2, 15-1 and 15-2; however the control system 5 may be arranged for controlling operation of any of these outriggers as well. Alternatively, in some embodiments, some or all of the system parts may be operated without the use of a control system, for example by crew members or an operator on board of the vessel. This may be done remote controlled or in any suitable or different manner, without departing from the present disclosure.

Figure 3:
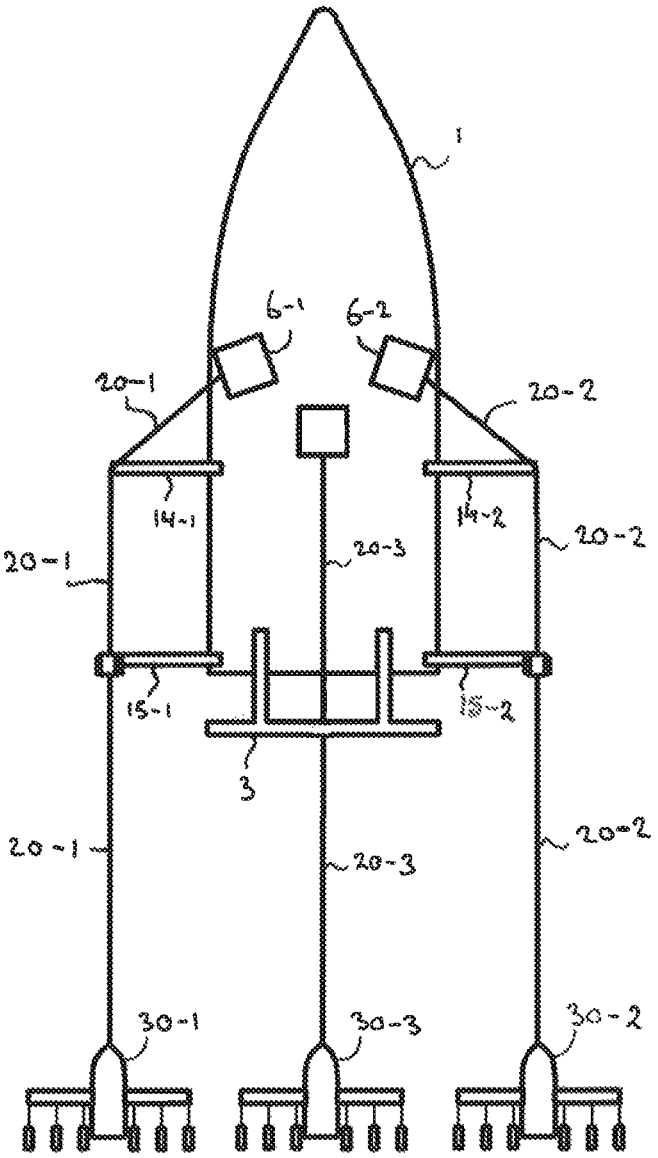
FIG. 3 schematically illustrates a carrier including a system in accordance with the present invention, the carrier towing marine equipment.

The system further includes a first and second main winch 6-1, 6-2. The first main winch 6-1 is located on the port side of the vessel 1. The second main winch 6-2 is located on the starboard side of the vessel 1. The main winches 6-1 and 6-2 control data cables 20-1 and 20-2. The data cables 20-1, 20-2 and 20-3 are the main operation cables for the marine equipment unit that are towed behind the vessel 1. For example, each of the cables 20-1 through 20-3 includes communication cables as well as provide a reinforced tow cable that allows to tow and hoist the marine equipment unit 30. The winches 6-1 and 6-2 allow to extend and retract the data cables 20-1 and 20-2 respectively on port and starboard side of the vessel 1. The midship main winch 7 allows extension and retraction of data cable 20-3 for towing and hoisting a main equipment unit amid ships of the vessel 1. The system for deployment and recovery of the marine equipment unit further includes a first front lateral outrigger 14-1 on port side of the vessel 1, and a second front lateral outrigger 14-2 on starboard side of the vessel 1. The system further includes a first aft lateral outrigger 15-1 on port side of the vessel 1, and a second aft lateral outrigger 15-2 on starboard side of the vessel 1. In operation during towing of the marine equipment unit, data cable 20-1 runs from main winch 6-1 via front lateral outrigger 14-1 and aft lateral outrigger 15-1 on starboard side to the towed marine equipment unit. In use, data cable 20-2 during towing runs from the main winch unit 6-2 via the front lateral outrigger 14-2 and the aft lateral outrigger 15-2 on starboard side to the marine equipment unit towed. Data cable 20-3 runs directly from the main winch 7 to the back of the ship 1, optionally guided via a sheave (not shown). As will be discussed later below, FIG. 3 illustrates a overview of the vessel 1 towing three marine equipment units 30-1, 30-2 and 30-3 behind the ship, using a system in accordance with the present invention.

Deployment of the amid ships marine equipment unit via data cable 20-3 is relatively straight forward. The A-frame 3 is used for hoisting the marine equipment unit 30-3 from deck 2 into the water. Deployment of the lateral marine equipment unit 30-1 and 30-2 is more difficult because the marine equipment units 30-1 and 30-2 are not to be deployed directly behind the ship 1 but preferably near the end of the extended outriggers 15-1 and 15-2. However, although the data cables 20-1 and 20-2 are reinforced such as to be strong enough for withstanding tensions and forces during towing and suspension of the marine equipment units therefrom, these cables 20-1 and 20-2 are typically prone to bending. When the cables 20-1 and 20-2 are bent too sharply, this may damage the internal communication cables within data cables 20-1 and 20-2. Taking this into account, this complicates the deployment of the marine equipment unit 30-1 and 30-2 on the two lateral sides of the ship near the ends of the aft lateral outriggers 15-1 and 15-2.

The system of the present invention allows to deploy the marine equipment units 30-1 and 30-2 while carefully guiding the data cables to a position at the ends of the aft lateral outriggers 15-1 and 15-2 without too much bending thereof. The system in accordance with the present invention therefore uses a first and a second manual tugger winch 10-1 and 10-2 that allow to extend and retract guide lines 25-2 and 25-2 respectively, which cooperate respectively with trumpets 24-1 and 24-2 that serve as tow line guides. For example manual winch 10-1 allows to extend and retract guide line 25-1 that runs via sheave 26-1 on the aft lateral outrigger 15-1 on port side and is connected to the trumpet 24-1. By retracting guide line 25-1, trumpet 24-1 is pulled towards a seat 18-1 on the aft lateral outrigger 15-1. During deployment, while suspending marine equipment unit 30-1 from the A-frame 3, data cable 20-1 can be led to the ultimate end of aft lateral outrigger 15-1 by retracting guide line 25-1 such as to place the trumpet 24-1 in seat 18-1. On starboard side, this is done in a similar manner via manual tugger winch 10-2, guide line 25-2, tow line guide or trumpet 24-2 and seat 18-2 on aft lateral outrigger 15-2. Here, guideline 25-2 likewise runs via a sheave 26-2 on the aft lateral outrigger 15-2 such as to pull the trumpet 24-2 into the seat 18-2 during deployment of marine equipment unit 30-2.

Figure 2A:
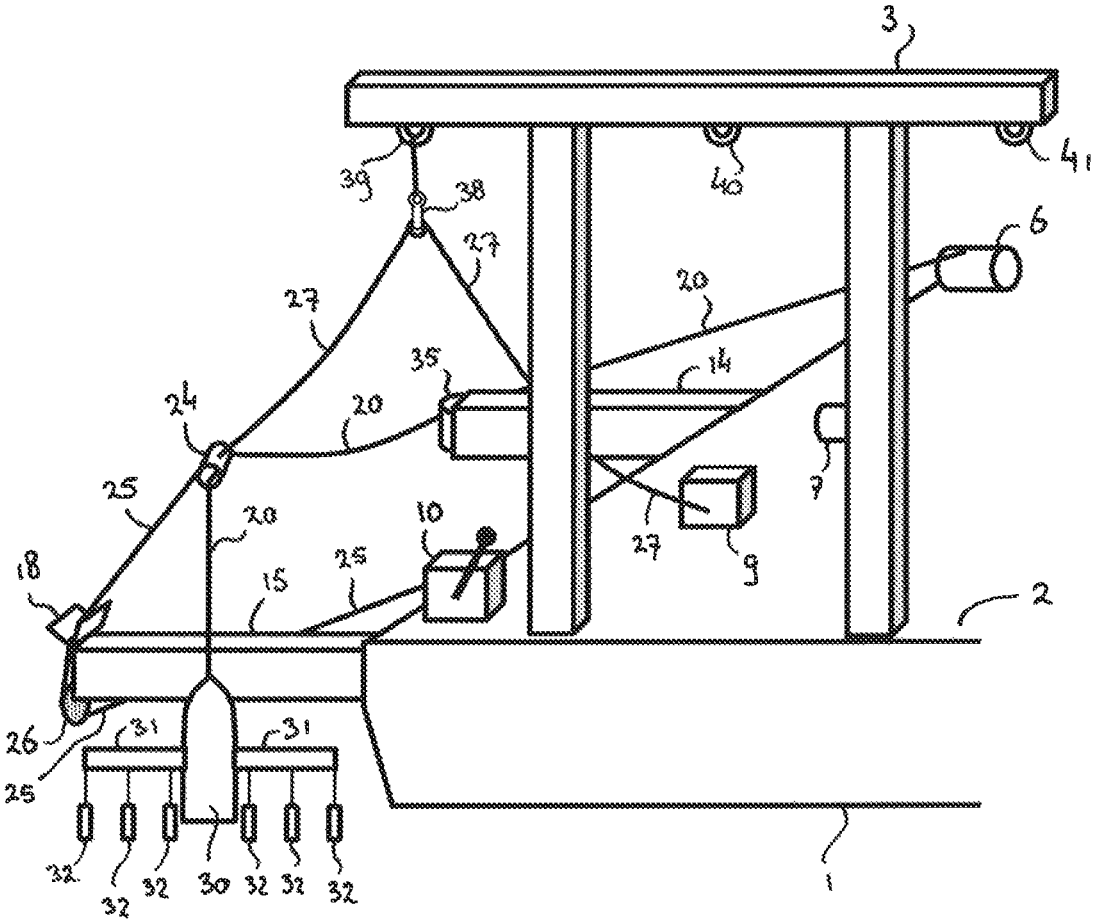
FIGS. 2A and 2B schematically illustrate a system in accordance with the present invention in use.
Figure 2B:
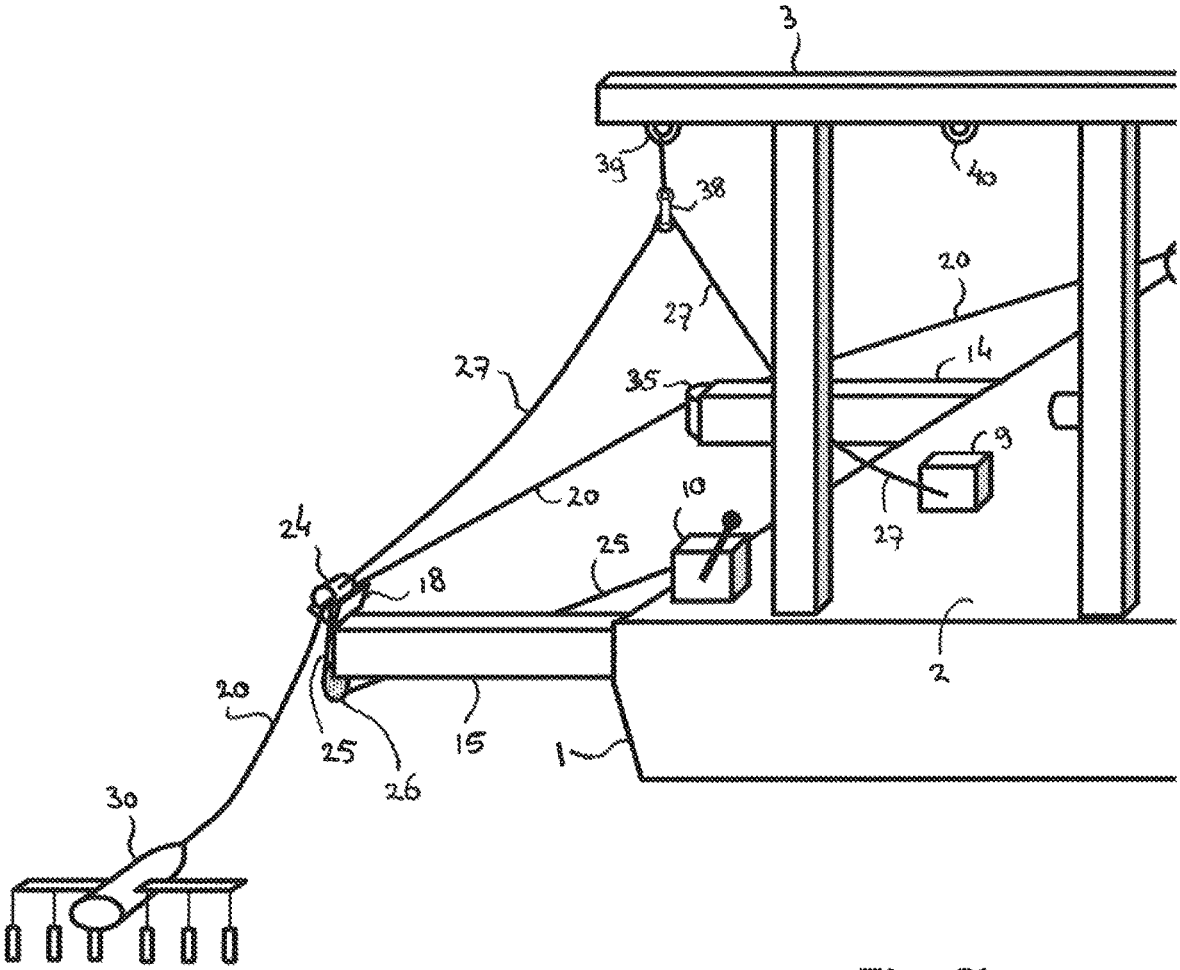

As may be appreciated, marine equipment unit 30-1 on the port side of the vessel may suspend from the A-frame 3 via a separate hoisting cable (not shown). However in the embodiment illustrated in FIG. 1, this is done in a different manner such as to allow easy recovery of the marine equipment unit 30-1 from the water as well. Also, in the manner in which it is done in the embodiment of FIG. 1, it is not necessary to disconnect the hoisting line after deployment. This is achieved via hydraulic tugger winch 9-1 and guide hoist line 27-1 which is also connected to the trumpet 24-1. Similarly, on starboard side of the vessel there is provided hydraulic tugger winch 9-2 and guide hoist line 27-2 connected to trumpet 24-2. Reference is made to FIGS. 2A and 2B wherein deployment of a marine equipment unit 30 on the port side of vessel 1 is schematically illustrated.

In FIG. 2A, marine equipment unit 30 is illustrated suspending from data cable 20. Marine equipment unit 30 is a remotely operated towed vehicle, enabling control over at least the sailing depth and/or the sailing level above the sea floor. ROTV thereby comprises side riggers or wing parts 31 on both lateral sides, from which a plurality of sensors 32 suspend. Each sensor 32 is in turn connected to a side rigger or wing part 31 of the ROTV 30 by a tow/data line. The plurality of sensors 32 suspend at different lateral positions of the wing parts 31. The sensors 32 may for example include magnetometers that allow to detect deviations in the earth magnetic field caused by metal objects on the sea floor. Such sensors may be used for finding wreckage, lost containers, metal ores, or lost ammunition. As may be appreciated, the present system and method is not limited to deployment of these type of marine equipment units, and any different type of marine equipment units other than the unit 30 shown in FIG. 2A may be deployed and recovered in a similar manner.

In FIG. 2A, prior to hoisting of the marine equipment unit 30, one end of the data cable 20, i.e. the end to which the marine equipment unit 30 is to be attached, is extended through trumpet 24. Trumpet 24 may be a donut shaped or double conical shaped part that allows to receive the data cable 20 there through, and enables free movement of the data cable 20 through the trumpet 24. Trumpet 24 in FIG. 2A is schematically illustrated as a small cylinder. Various types of trumpets and similar functional parts are known to the skilled person that are suitable for serving as tow line guide 24. After extending data cable 20 through trumpet 24, the data cable 20 is connected to the marine equipment unit 30 on deck 2. Then guide line 25 which is extended from manual winch 10 via sheave block 26 back to the deck 2, is connected to the trumpet 24. Also guide hoist line 27 from hydraulic winch 9 is connected to trumpet 24, while marine equipment unit still lies on deck 2.

Next, using guide hoist line 27, the trumpet 24 is lifted suspending from the A-frame 3. To this end, the guide hoist line 27 runs via a sheave 38 connected to a connection ring 39 on the A-frame. As may be appreciated, hoist line 27 may also be connected directly via a sheave on the A-frame, or in any alternative manner suitable for hoisting the guide hoist line 27 from the A-frame. By hoisting the trumpet 24, data cable 20 is lifted simultaneously, and likewise the marine equipment unit 30 suspending therefrom. A crew member may then operate manual tugger winch 10 slightly retracting guide line 25 to bring the trumpet to the side of the vessel 1. This may for example result in the situation illustrated in FIG. 2A wherein the marine equipment unit 30 is suspending from the data line 20, while guide line 25 pulls the trumpet towards the side to bring the marine equipment unit outside. While slowly extending the guide hoist line 27, the manual tugger winch 10 is operated such as to pull the trumpet 24 towards the seat 18 at the end of the aft lateral outrigger 15. Because guide line 25 runs via sheave 26, the tow line guide or trumpet 24 eventually ends up in seat 18, where it is received and held in place.

This is schematically illustrated in FIG. 2B, where the trumpet 24 is placed in the seat 18 and is kept there by the tension of the guide line 25 by means of the winch 10. The guide hoist line 27 that extends from hydraulic winch 9 maintains in this position connected to the trumpet 24, to allow easy recovery of the marine equipment unit 30 from the water after use. As may be appreciated, data line 20 may be extended using the main winch 6 on port side such as to tow the marine equipment unit 30-1 at some distance behind the vessel 1.

In FIGS. 1, 2A, 2B and 3, the lateral outriggers 14-1, 14-2, 15-1 and 15-2 are illustrated in an extended position. As may be appreciated, although this is desired in order to tow the marine equipment unit 30-1, 30-2 and 30-3 behind the ship 1 at sufficient distance from each other, this position of the lateral outriggers is not desired in port or under all conditions. For this reason, as illustrated in FIG. 1, each of the outriggers 14-1, 14-2, 15-1 and 15-2 is connected to the vessel 1 via a hingable connection 11 that allows to align the outriggers against the side of the hull of vessel when they are not in use. As an additional advantage, controlling the extension angle of at least the aft lateral outriggers 15-1 and 15-2 (and optionally also the front lateral outriggers 14-1 and 14-2), also allows to control the distance between the marine equipment units 30-1, 30-2 and 30-3 while these are towed. Alternatively or additionally, the seats 18 on the aft lateral outriggers 15 may be connected to the aft lateral outriggers 15 via a rail (not shown) to bring the seats 18 to a less extended position than as illustrated in FIG. 2A. This may for example be implemented in combination with the alternative aft lateral outrigger configuration illustrated in FIG. 4B, to be explained further below. Moreover, to facilitate movement of the data cable over the end of front lateral outrigger 14, lateral outrigger 14 comprises a further sheave 35 that provides such frictionless movement.

Recovery of the marine equipment unit 30 in FIG. 2B is achieved in the opposite manner as the deployment thereof. In that case, data cable 20 is retracted such as to bring the marine equipment unit 30 towards the trumpet 24. When the marine equipment unit 30 is below the trumpet and below the aft lateral outrigger 15, the hoist line 27 is pulled by winch 9, and guide line 25 is released a little using the winch 10. Slowly, the trumpet 24 is brought towards the A-frame 3 while being lifted by means of the hoist guide line 27. The marine equipment unit is simultaneously lifted from the water while being kept at safe distance from the boat 1 and the outrigger 15. When the marine equipment unit is close enough to the boat 1, it can be carefully pulled in on deck 2 of the boat, and disconnected from data cable 20 safely.

FIG. 3, as described above, illustrates towing of several marine equipment units 30-1, 30-2 and 30-3 behind a vessel 1 using a system in accordance with the present invention. Ideally, the distance between each of the magnetometers 32 behind the marine equipment units 30-1 to 30-3 is the same. Therefore, marine equipment units 30-1 and 30-2 would ideally be brought closer to the amid ships marine equipment unit 30-1 such that the magnetometers 32 are at equidistant positions. A broad scan lane is thereby achieved which can be scanned with uniform accuracy across the width of the scan lane.

Figure 4A:
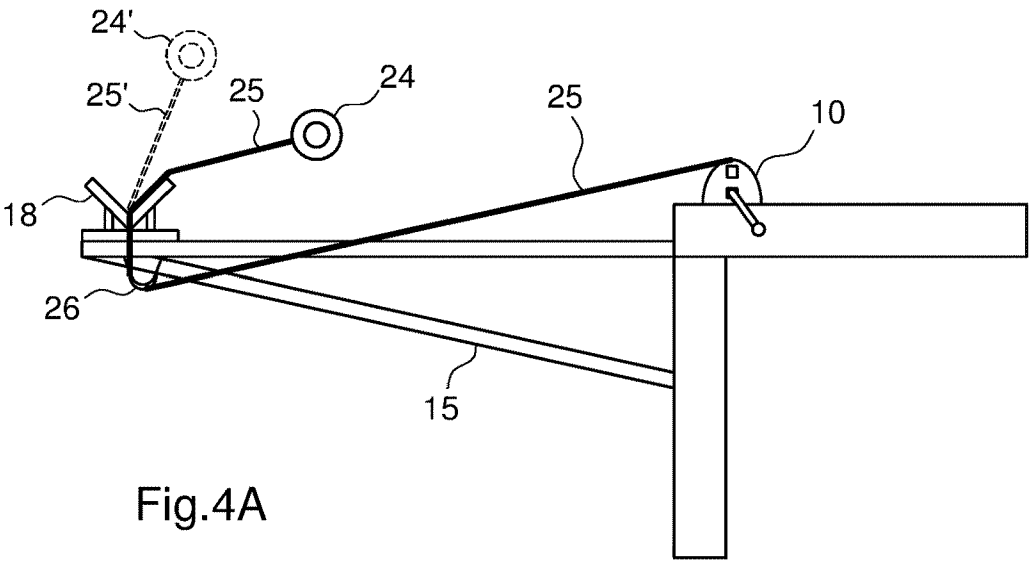
FIGS. 4A and 4B schematically illustrates different embodiments of an aft lateral outrigger.
Figure 4B:
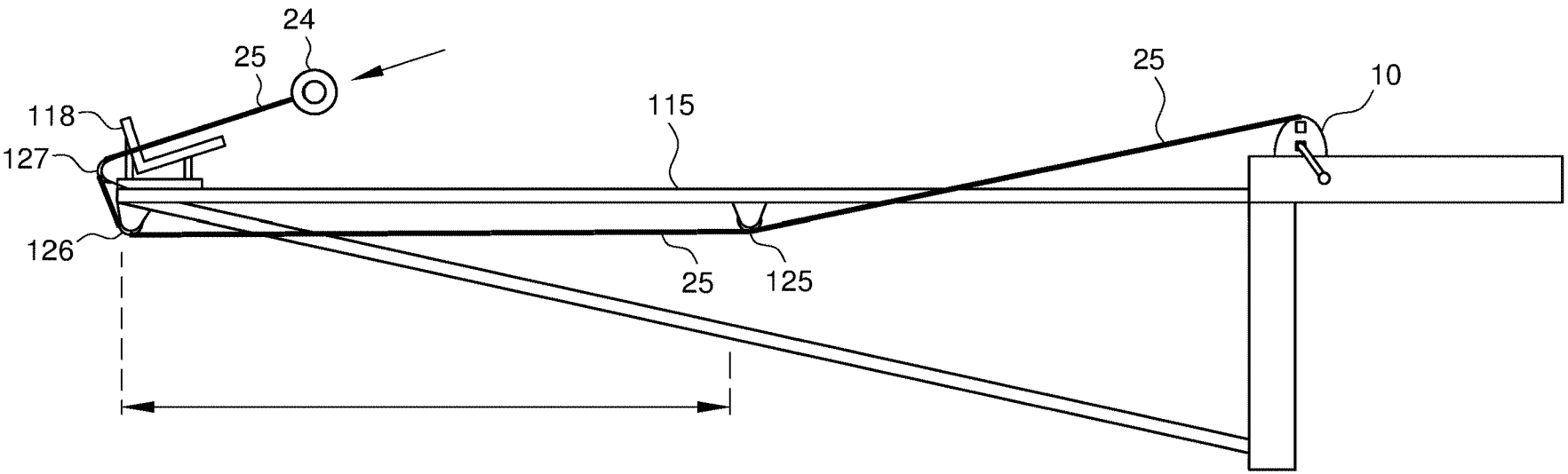

FIGS. 4A and 4B illustrate two different versions of the aft lateral outrigger 15. The version which is also illustrated in FIGS. 2A and 2B comprises a sheave 26 underneath the seat 18 that allows to bring in the trumpet 24 into the seat 18. Under optimal conditions, the trumpets 24 is sufficiently above the seat 18, such as illustrated in position 24' with guide line 25'. However, if the seat 18 is too far extended towards the end of the aft lateral outrigger 15, or if the hoist guide line 27 has allowed the trumpet 24 to be located too low with respect to seat 18, this may complicate guiding of the trumpet towards the seat 18. A different embodiment of the aft lateral outrigger is illustrated in FIG. 4B. Here, the guide line 25 is guided via sheaves 125, 126 and 127. The aft lateral outrigger has been designated with reference numeral 115 to distinguish it from the aft lateral outrigger 15 of FIG. 4A. The seat 118 of aft lateral outrigger 115 in FIG. 4B has an asymmetric V-shape. The asymmetric V-shape has a relatively flat and long first leg and a short high back leg. The guide line 25 via sheaves 125, 126 and 127 now under most conditions allows to pull the trumpet 24 safely into the seat 118. Moreover, as a result of this alternative shaping of the seat 118 and the additional sheaves 125, 126 and 127, the aft lateral outrigger 115 may be much longer than the regular aft lateral outrigger 15 of FIG. 4A. Therefore, a broader scan lane may be spanned. In addition, as described hereinabove, the seat 118 may be placed on a rail to place it at any desired position.

The present invention has been described in terms of some specific embodiments thereof. It will be appreciated that the embodiments shown in the drawings and described herein are intended for illustrated purposes only and are not by any manner or means intended to be restrictive on the invention. It is believed that the operation and construction of the present invention will be apparent from the foregoing description and drawings appended thereto. It will be clear to the skilled person that the invention is not limited to any embodiment herein described and that modifications are possible which should be considered within the scope of the appended claims. Also kinematic inversions are considered inherently disclosed and to be within the scope of the invention. Moreover, any of the components and elements of the various embodiments disclosed may be combined or may be incorporated in other embodiments where considered necessary, desired or preferred, without departing from the scope of the invention as defined in the claims.

In the claims, any reference signs shall not be construed as limiting the claim. The term 'comprising' and 'including' when used in this description or the appended claims should not be construed in an exclusive or exhaustive sense but rather in an inclusive sense. Thus the expression 'comprising' as used herein does not exclude the presence of other elements or steps in addition to those listed in any claim. Furthermore, the words 'a' and 'an' shall not be construed as limited to 'only one', but instead are used to mean 'at least one', and do not exclude a plurality. Features that are not specifically or explicitly described or claimed may be additionally included in the structure of the invention within its scope. Expressions such as: "means for . . . " should be read as: "component configured for . . . " or "member constructed to . . . " and should be construed to include equivalents for the structures disclosed. The use of expressions like: "critical", "preferred", "especially preferred" etc. is not intended to limit the invention. Additions, deletions, and modifications within the purview of the skilled person may generally be made without departing from the spirit and scope of the invention, as is determined by the claims. The invention may be practiced otherwise then as specifically described herein, and is only limited by the appended claims.

The invention claimed is:

1. A system for the deployment, towing and recovery of marine equipment from a waterborne carrier, the carrier comprising a hoisting arrangement including a hoist winch comprising a lift line configured to lift the marine equipment from the carrier into a water, wherein the system is configured to cooperate with the hoisting arrangement, and the system comprising:

at least one lateral deployment-recovery assembly for deployment and recovery of the marine equipment on a lateral side of the carrier, the at least one lateral deployment-recovery assembly including:

a tow winch comprising a tow line configured to tow the marine equipment; and an aft lateral outrigger connected to the carrier configured to keep the tow line at an extended position on a lateral side of the carrier during towing;

a tow line guide configured to receive the tow line; and a guider winch including a guide line, the guide line being attachable to the tow line guide;

wherein the aft lateral outrigger comprises a seat configured to receive the tow line guide, and a sheave configured to guide the guide line such as to enable guiding of the tow line guide towards the seat.

2. The system according to claim 1, wherein the seat is mounted at a first position and the sheave is located at a second position on the aft lateral outrigger, wherein the second position is located at least as remote as the first position from a connection between the aft lateral outrigger and the carrier.

3. The system according to claim 1, wherein the tow line guide is configured to enable the tow line to be freely movable there through, the tow line guide comprising a through hole or opening having size that is larger than a diameter of the tow line.

4. The system according to claim 3, wherein the tow line guide is shaped to enable to be circumferentially arranged around the tow line.

5. The system according to claim 4, wherein the seat is shaped to enable receipt of the tow line guide.

6. The system according to claim 1, wherein the seat is movably mounted on the aft lateral outrigger to enable adjustment of a tow point from where the tow line is towed via the aft lateral outrigger.

7. The system according to claim 6, wherein the sheave and the seat are located on a same side of the aft lateral outrigger.

8. The system according to claim 1, wherein the at least one lateral deployment-recovery assembly further comprises:

a front lateral outrigger connected to the carrier between the tow winch and the aft lateral outrigger, including a guide configured to receive the tow line.

9. The system according claim 1, wherein the at least one lateral deployment-recovery assembly further comprises:

a first lateral deployment-recovery assembly for deployment and recovery of a first marine equipment unit on a first lateral side of the carrier; and a second lateral deployment-recovery assembly for deployment and recovery of a second marine equipment unit on a second lateral side of the carrier.

10. The system according to claim 1, further comprising a mid tow winch unit configured to enable towing of a further marine equipment unit, the further marine equipment unit to be lifted into the water by the hoist arrangement directly.

11. The system according to claim 1, further comprising a controller configured to control one or more winches of the at least one lateral deployment-recovery assembly or the hoist winch.

12. The system according to claim 11, wherein the controller is configured to coordinate operation of one or more of the hoist winch, the guider winch or the tow winch.

13. A carrier configured for the deployment, towing and recovery of marine equipment into a water, the carrier comprising:

a hoisting arrangement including a hoist winch comprising a lift line configured to lift the marine equipment from the carrier into a water, the system configured to cooperate with the hoisting arrangement, and comprising at least one lateral deployment-recovery assembly for deployment and recovery of the marine equipment on a lateral side of the carrier, the at least one lateral deployment-recovery assembly including:

a tow winch comprising a tow line configured to tow the marine equipment; and an aft lateral outrigger connected to the carrier configured to keep the tow line at an extended position on a lateral side of the carrier during towing;

a tow line guide configured to receive the tow line; and a guider winch including a guide line, the guide line being attachable to the tow line guide;

wherein the aft lateral outrigger comprises a seat configured to receive the tow line guide, and a sheave configured to guide the guide line such as to enable guiding of the tow line guide towards the seat.

14. A method of deploying marine equipment from a waterborne carrier into a water, wherein the marine equipment is to be deployed into the water at a lateral side of the carrier, the method including:

connecting a tow line provided by a tow winch to the marine equipment, the tow line extending from a tow winch;

connecting a lift line to the marine equipment, the lift line being provided by a hoist winch of a hoisting arrangement on the carrier; and lifting the marine equipment from the carrier into the water using the hoisting arrangement;

wherein the deployment is performed using a lateral deployment-recovery assembly, the method thereby further comprising the steps of:

prior to connecting the tow line, extending the tow line through a tow line guide, and connecting the tow line guide to a guide line provided by a guider winch, the guide line running over a sheave on the aft lateral outrigger; and during said lifting of the marine equipment, operating the guider winch to pull the tow line guide towards a seat mounted onto the aft lateral outrigger connected to the carrier, for keeping the tow line at an extended position on a lateral side of the carrier during towing.

15. The method according to claim 14, wherein the marine equipment comprises at least one of: a remotely operated towed vehicle; an array of remotely operated towed vehicles, such as a plurality of remotely operated towed vehicles towed side-by-side; one or more autonomous underwater vehicles; a seismic sensor array; one or more paravanes; or a combination of marine equipment units.

* * * * *